US008517376B2

(12) United States Patent
Walsh

(10) Patent No.: US 8,517,376 B2
(45) Date of Patent: Aug. 27, 2013

(54) PRINT SYSTEM WITH LINEAR ENCODER FOR TRAY PRINT MEDIA SIZING

(75) Inventor: Martin Richard Walsh, St. Albans (GB)

(73) Assignee: Xerox Corporation, Norwalk, CT (US)

( * ) Notice: Subject to any disclaimer, the term of this patent is extended or adjusted under 35 U.S.C. 154(b) by 863 days.

(21) Appl. No.: 12/699,917

(22) Filed: Feb. 4, 2010

(65) Prior Publication Data

US 2011/0188912 A1 Aug. 4, 2011

(51) Int. Cl.
*B65H 1/00* (2006.01)

(52) U.S. Cl.
USPC ..... 271/171

(58) Field of Classification Search
USPC ..... 271/171
See application file for complete search history.

(56) References Cited

U.S. PATENT DOCUMENTS

| | | | | |
|---|---|---|---|---|
| 5,053,814 | A * | 10/1991 | Takano et al. | 399/23 |
| 5,360,207 | A * | 11/1994 | Rauen et al. | 271/265.02 |
| 5,573,236 | A * | 11/1996 | Petocchi et al. | 271/265.02 |
| 5,574,551 | A * | 11/1996 | Kazakoff | 399/45 |
| 6,073,925 | A * | 6/2000 | Sato | 271/171 |
| 6,266,512 | B1 * | 7/2001 | de Koning et al. | 399/370 |
| 6,546,210 | B1 * | 4/2003 | Nakamura | 399/12 |
| 6,619,656 | B2 * | 9/2003 | Guddanti et al. | 271/171 |
| 6,958,833 | B2 | 10/2005 | TeWinkle | |
| 7,004,462 | B2 * | 2/2006 | Bryer | 271/171 |
| 7,111,841 | B2 | 9/2006 | Jacobs et al. | |
| 7,854,427 | B2 * | 12/2010 | Tsujinishi | 271/171 |
| 7,885,597 | B2 * | 2/2011 | Gast et al. | 399/389 |
| 2005/0133983 | A1 | 6/2005 | Jacobs et al. | |

* cited by examiner

*Primary Examiner* — Kaitlin Joerger
*Assistant Examiner* — Ernesto Suarez
(74) *Attorney, Agent, or Firm* — Ronald E. Prass, Jr.; Prass LLP

(57) ABSTRACT

According to aspects of the embodiments there is provided a printing system such as a printer, a copier, and a facsimile machine having an automatic print media size determining apparatus. At least one side guide is coupled with a linear encoder and an external sensor to determine the size of media received on a support surface. According to one implementation, the support surface is provided by a paper tray. The paper tray includes a support surface configured to receive media, at least one side guide, and an encoder that moves with the side guide. The side guide is movably supported for continuously adjustable positioning relative to the tray to conform dimensionally with print media received in the tray. The print media size determining apparatus includes an external position-detecting sensor associated with the encoder and the side guide that is operative to generate a unique electrical pattern corresponding with a detected position of the side relative to the tray. The unique electrical pattern is indicative of the size of the media detected in the tray.

12 Claims, 6 Drawing Sheets

PRINT SYSTEM WITH LINEAR ENCODER FOR TRAY PRINT MEDIA SIZING

BACKGROUND

This disclosure relates in general to copier/printers, and more particularly, to an automatic print media size detector.

Printing systems commonly use a plurality of paper trays to enable printing on different sizes of paper. In order to enhance productivity of the apparatus, it is desired to know exactly the size paper present in the paper tray to enhance the printing operation on the paper. By knowing what size paper is present in the paper tray, throughput of the printing apparatus can be maximized to reduce the time required for a printing operation.

Several techniques are known for conveying to printing system information about the contents of a paper tray. One technique uses a single paper tray that can be configured to receive various sizes of paper. Many home and small-business printers utilize such a single paper tray. However, reconfiguration only accommodates a series of discrete paper sizes, such as letter-sized, legal-sized and A4-sized paper. Typically, a series of notches or holes is provided in the tray, and one or more media stops are positioned into a selected set of notches or holes to accommodate one of the available paper sizes. However, only a handful of predefined discrete paper sizes are available.

According to even another technique, a printing system uses a look-up table that monitors the position of microswitches that indicate the received print media size. In the past, this has been achieved by using a series of switches and the logic of on/off switch positions to detect the presence of common paper sizes. However, paper size can only be determined in accordance with the predetermined location of the switches and does not determine specific sheet sizes since the switches are incrementally arranged.

For the reasons stated above, and for other reasons stated below which will become apparent to those skilled in the art upon reading and understanding the present specification, there is a need in the art for a print media size detector capable of detecting an infinite number of media sizes within a range of sizes. Furthermore, there is a need for an improved paper tray utilizing such a media size detector.

SUMMARY

According to aspects of the embodiments, there is provided a printing system such as a printer, a copier, and a facsimile machine having an automatic print media size determining apparatus. At least one side guide is coupled with a linear encoder and an external sensor to determine the size of media received on a support surface. According to one implementation, the support surface is provided by a paper tray. The paper tray includes a support surface configured to receive media, at least one side guide, and an encoder that moves with the side guide. The side guide is movably supported for continuously adjustable positioning relative to the tray to conform dimensionally with print media received in the tray. The print media size determining apparatus includes an external position-detecting sensor associated with the encoder and the side guide that is operative to generate a unique electrical pattern corresponding with a detected position of the side relative to the tray. The unique electrical pattern is indicative of the size of the media detected in the tray.

DETAILED DESCRIPTION

Figure 1:
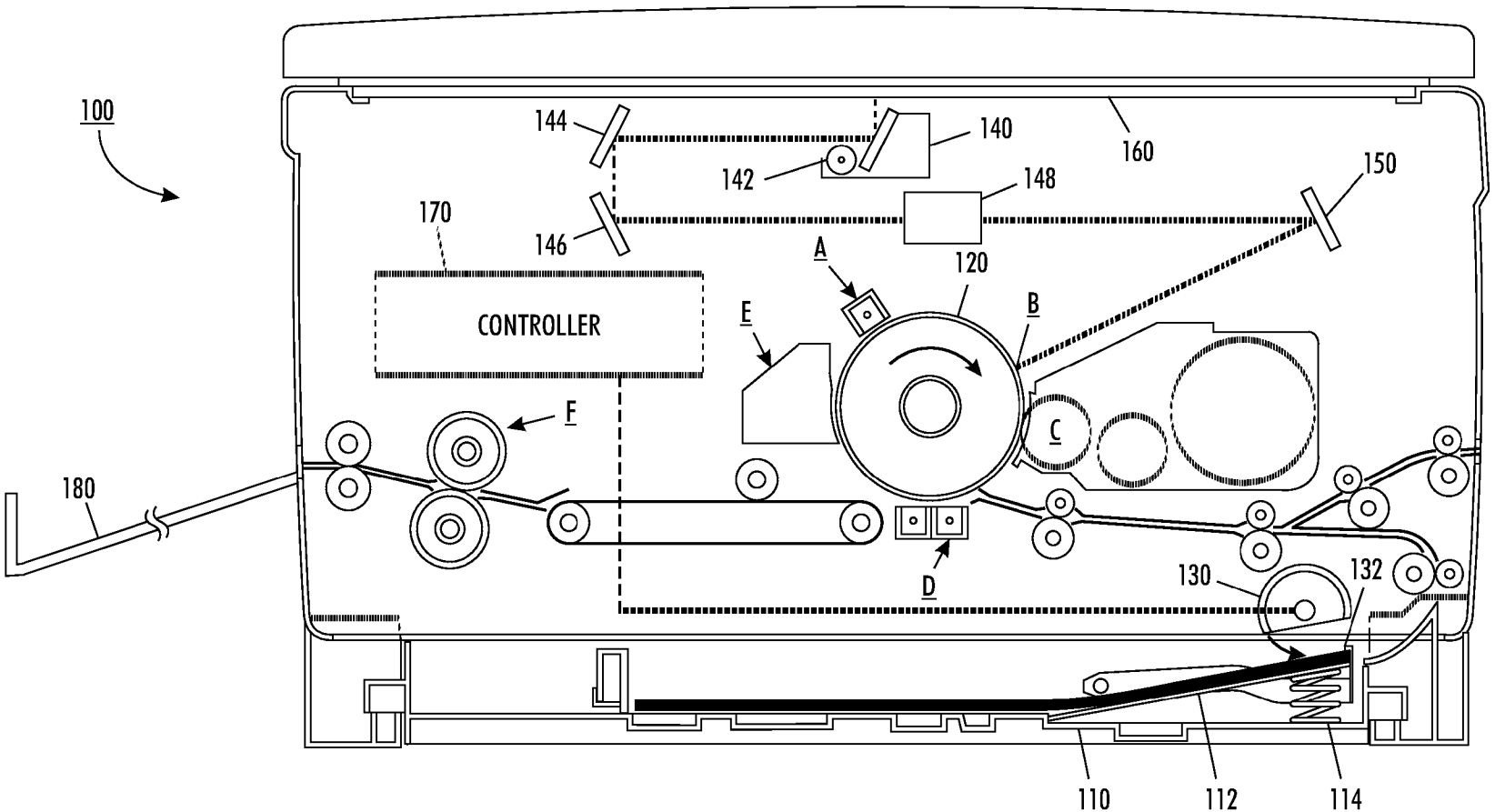
FIG. 1 is a schematic representation of a printing system having a print media tray in accordance to an embodiment.

Aspects of the disclosed embodiments relate to a sheet media size determining apparatus when supplying media to a print system or when preparing to scan an original document. In the following description, numerous specific details are set forth for one specific implementation, as used on a print tray for a print device in order to provide a thorough understanding of the present invention. It will be apparent, however, to one skilled in the art that the present invention may be practiced without these specific details. In other instances, well-known methods and structural components are not described in detail in order to not obscure the present invention. It is understood that the present invention is comprised of paper tray components, some of which are readily manufacturable using well-known technology. The present invention addresses the problem of detecting media size when provided on a support surface, such as a paper tray, to a printing system, such as a copier or a printer. More particularly, print media that do not fit standard sizes typically offered to a printing system are capable of being detected in accordance to the invention. Users have had to either use a multipurpose tray input or use a custom input tray, where the user manually enters the dimensions of the media that are being presented to the device. Accordingly, the automatic sensing technique of enables size determination of any loaded media loaded onto a support surface or print media tray.

The disclosed embodiments include a sheet media size determining apparatus comprising: a tray having a support surface to receive print media; at least one side guide in contact with at least one edge of the print media, wherein the at least one side guide is movably supported to conform dimensionally with the print media received in the tray; an encoder mounted to the tray and connected through a linkage mechanism to the at least one side guide, wherein movement of the at least one side guide causes encoder displacement; and a sensor external to the tray capable of generating from encoder displacement a unique electrical pattern corresponding to a position of the at least one side guide relative to the tray; wherein the unique electrical pattern is indicative of the size of the received print media.

The disclosed embodiments further include a sheet media size determining apparatus comprising: a tray having a support surface to receive print media; at least one side guide in contact with at least one edge of the print media, wherein the at least one side guide is movably supported to conform dimensionally with the print media received in the tray; an encoder mounted to the tray and connected through a linkage mechanism to the at least one side guide, wherein movement of the at least one side guide causes encoder displacement; and a controller having a processor that executes instructions to determine the size of the received print media by: generating from encoder displacement a unique electrical pattern corresponding to a position of the at least one side guide relative to the tray; determining from the unique electrical pattern the size of the received print media.

Still further, the disclosed embodiments include two side guides, one of the side guides indicative of print media width and the other of the side guides indicative of print media length.

The disclosed embodiment also include a gear at the linkage mechanism to reduce lateral movement from the at least one side guide.

In yet another embodiment a media holding apparatus comprising a tray having a support surface to receive print media; at least one side guide in contact with at least one edge of the print media, wherein the at least one side guide is movably supported to conform dimensionally with the print media received in the tray; and an encoder mounted to the tray and connected through a linkage mechanism to the at least one side guide, wherein movement of the at least one side guide causes a displacement at the encoder; wherein markings on the encoder when read by an external sensor produce a unique electrical pattern corresponding to a position of the at least one side guide relative to the tray; wherein the unique electrical pattern is indicative of the size of the received print media.

In another embodiment, the media holding apparatus includes linkage mechanism to transmit and rotate movement from the at least one side guide; wherein movement of the at least one side guide is parallel to the displacement at the encoder; wherein the linkage mechanism includes a rack attached to a pinion to cause displacement at the encoder; and wherein the linkage mechanism includes a gear to reduce lateral movement from the at least one side guide.

Embodiments as disclosed herein may also include computer-readable media for carrying or having computer-executable instructions or data structures stored thereon. Such computer-readable media can be any available media that can be accessed by a general purpose or special purpose computer such as a controller. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

The term "print media" generally refers to a usually flexible, sometimes curled, physical sheet of paper, plastic, or other suitable physical print media substrate for images, whether precut or web fed.

The term "printing system" as used herein refers to a digital copier or printer, xerographic printing machine, printing apparatus, bookmaking machine, facsimile machine, multifunction machine, or the like and can include several marking engines, as well as other print media processing units, such as paper feeders, finishers, and the like. The term "Print job" or "document" can include a plurality of digital pages or electronic pages to be rendered as one or more copies on a set of associated sheets of print media, each page, when rendered constituting the front or backside of a sheet. The pages of a print job may arrive from a common source and, when rendered, be assembled at a common output destination.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

FIG. 1 shows an automatic xerographic printing machine 100 including the print media tray 110, according to the present invention. Although the present invention is particularly well suited for use in automatic xerographic apparatus, it is equally well adapted for use with any number of other devices in which cut sheets of material (print media) are fed from a sheet supply source. The printer includes a photosensitive drum 120 which is rotated in the direction indicated by the arrow to pass sequentially through a series of xerographic processing stations; a charging station A, an imaging station B, a developer station C, a transfer station D and a cleaning station E.

Figure 5:
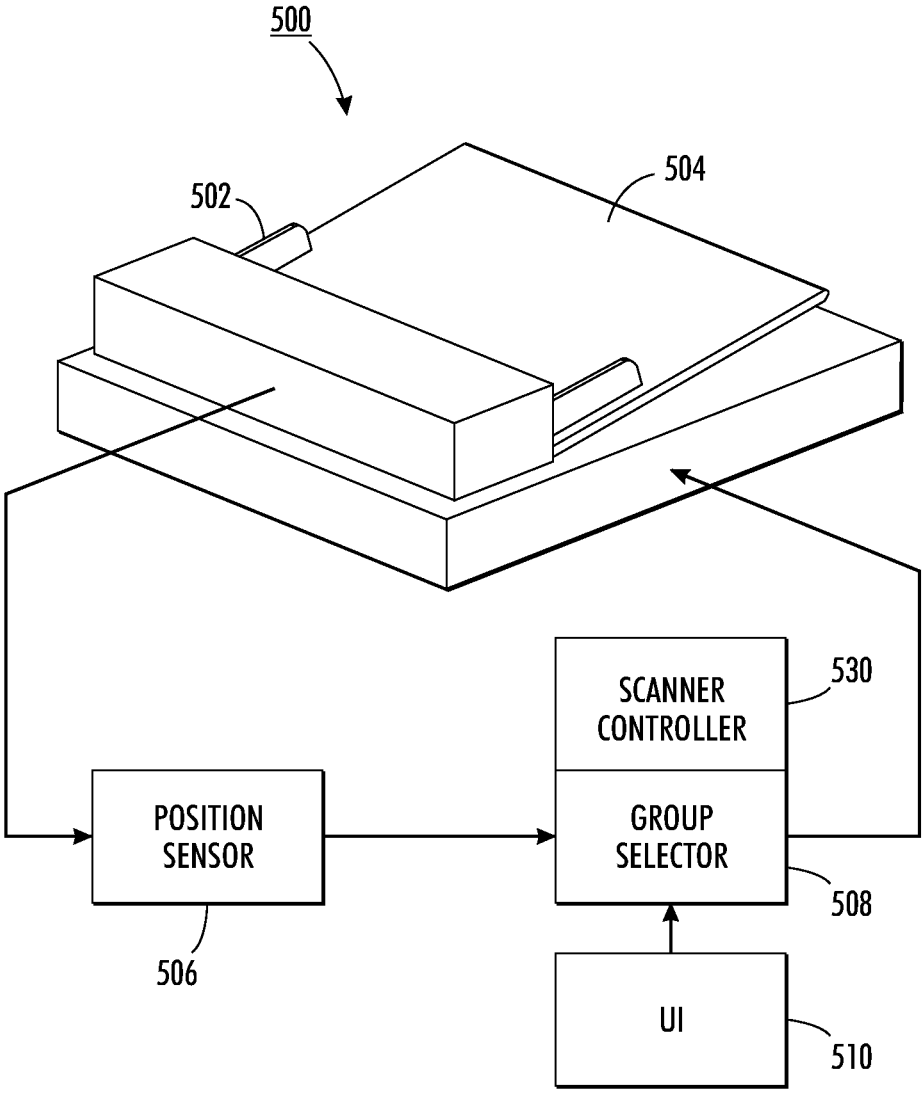
FIG. 5 is a simplified perspective view of a document holder used in conjunction with a scanner in accordance to an embodiment.

A document to be reproduced is placed on imaging platen 160 and scanned by moving optical system 140 including a lamp 142, mirrors 144, 146 and 150 and lens 148 to produce a flowing light image on the drum surface which had been charged at charging station A. The optical system can be replaced by a document handler, as shown in FIG. 5, with scanner incorporating a linear array of photosensors. The document handler incorporates the print media size determining apparatus in order to minimize blank data that simply take up space in a downstream memory and can produce imaging anomalies in the reproduced copy. The image is then developed at development station C to form a visible toner image. The print media tray 110 according to the present invention is inserted from the front of the machine into the plane of FIG. 1 in the direction illustrated by arrow 104 in FIG. 2. The stack of sheets is supported in the print media tray 110 by sheet stack support platform 112 which is urged upwardly by a lift motor 114 toward the feed roll 130. The feeding of sheets is actuated by the controller 170 to feed a sheet from the print media tray 110 to registration rolls in synchronous relationship with the image on the drum surface to the transfer station D. Controller 170 includes a processor, commercially available from Intel, Cyrix and others. Controller 170 also includes random-access memory (RAM), read-only memory (ROM), and one or more mass storage devices. Following transfer of the toner image to the copy sheet, the copy sheet is stripped from the drum surface and directed to the fusing station F to fuse the toner image on the copy sheet after which the drum surface itself continues to the cleaning station E where residual toner remaining on the drum surface is removed prior to the drum surface again being charged at charging station A. Upon leaving the fuser, the copy sheet with the fixed toner image thereon is transported to sheet collecting cassette 180.

Figure 2:
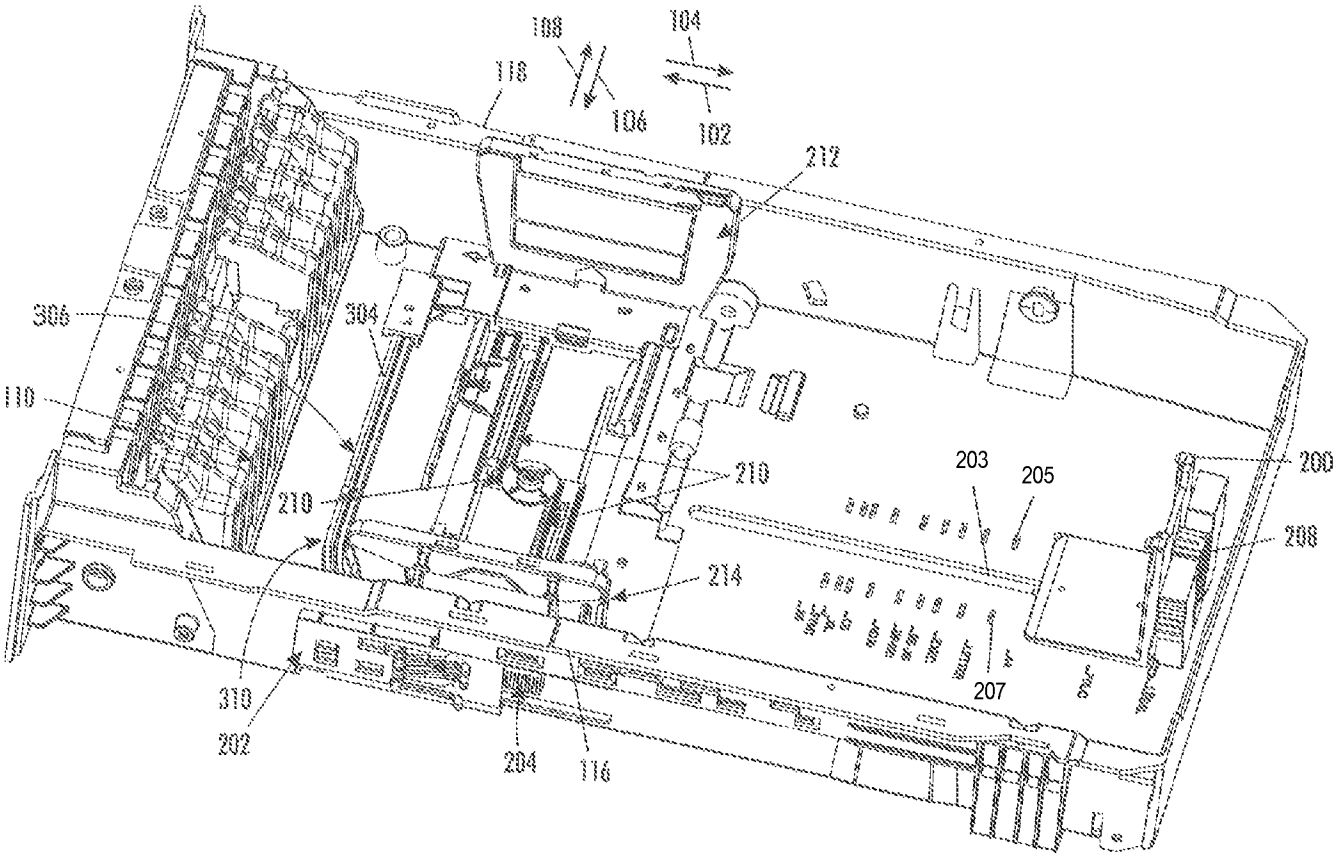
FIG. 2 shows a three dimensional view showing in detail the print media tray in accordance to an embodiment.
Figure 3:
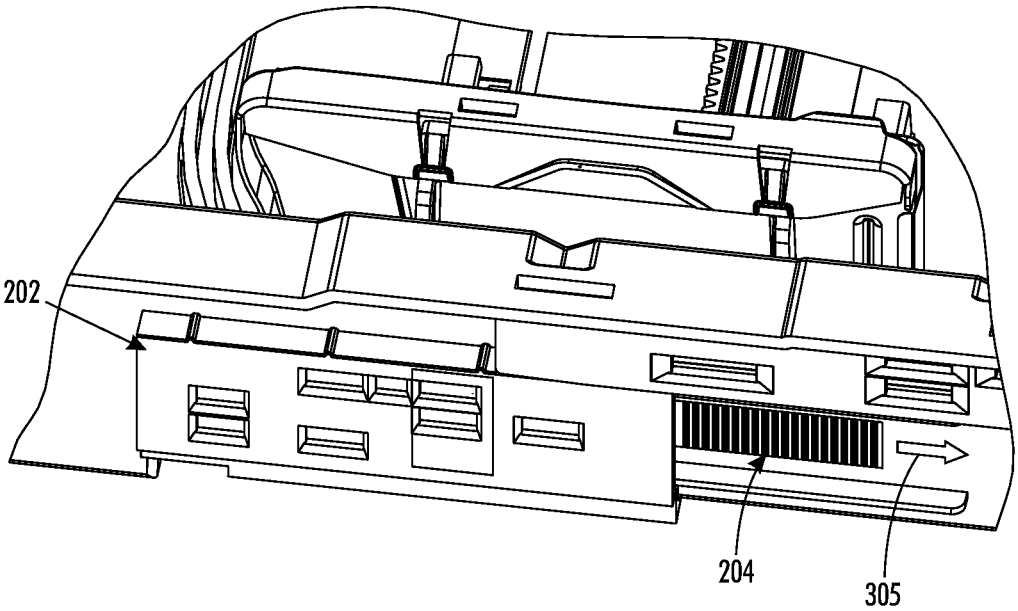
FIG. 3 shows a three dimensional view of the print media tray and linear encoder in accordance to an embodiment.

Referring more particularly to FIGS. 2 and 3, the automatic sheet size sensing mechanism will be discussed in greater detail. Typically, the print media tray or drawer bottom is of a one-piece molded plastic, which has additional plastic features incorporated therein or added thereto including, for example, a rear frame member and side frame members 116 and 118.

When a stack of sheets is placed on the sheet support platform 112, a rear sheet edge side guide 200 is moved into position in order to contact the rear edge of the sheets. The side guide is movably supported for continuously adjustable positioning relative to the print media tray to conform dimensionally with media received in the tray. The rear sheet edge side guide 200 rides in a mounting slot 203 and two series of slots 205,207 and has at its inboard end a pressure locking member 208 to hold it in place against the rear edge of the stack of sheets. Center registration of all documents can be conventionally provided by a well-known dual rack and pinion connection 210 of opposing side guides 212, 214 of the print media tray 110. The side guides 212, 214 thus automatically move together towards or away from one another by the same amount, so as to center the sheet stack irrespective of the size of the loaded sheets. The side guide is movably supported for continuously adjustable positioning relative to the print media tray to conform dimensionally with media received in the tray. As with the rear sheet edge guide 200, the opposing side guides 212, 214 can also include a locking member that holds the opposing side guides 212, 214 in place. As should be appreciated, only center registered side guides 212 and 214 are shown. However, non-center registered guides can be used.

In order to adapt the printing system 100 to multiple sheet sizes, the size of the sheets must be detected. The size of the sheets must be detected in order to avoid printing outside of the intended printing area or to utilize all of the printing area. As should be appreciated with solid ink printers, ink that is not transferred to the sheet remains in the printing mechanism 100 where damage to the printing mechanism 100 or future prints may occur. As such, a sheet size detection apparatus determines the size of the sheet and an actuator accurately positions the sheet size detection apparatus.

The sheet size detection apparatus utilizes the position of the opposing side guides 212 and 214, a linear encoder 204 displaced a proportional distance, and an internal sensor (not shown) in the printing system 100 but external to the print media tray 110. The mounting of the linear grating on the tray and the motion of the tray allows the sensor located on the machine to detect the edges when the tray is opened or closed The sensor can then interpret the edges as a paper size. It is sufficient to use only one of the opposing side guides 212, 214 for size detection because the side guides 212, 214 are connected together by the rack and pinion connection 210 and therefore move symmetrically. However, as should be appreciated, the position of the rear sheet edge side guide 200 can be used. As shown in FIG. 2, the sheet size detection apparatus includes a side plate 202 with a linkage mechanism that moves the linear encoder. The side plate 202 moves in the direction indicated by the arrows 102, 104 by a mounting slot integral with or attached to the side frame member 116. The linear encoder 204 at its most basic has a plurality of marks or pattern on an encoder strip formed at regular intervals that indicate the position of the at least one side guide relative to the tray. In the linear encoder the markings can be arranged in a unique pattern, the electrical signals resulting from the markings is a unique electrical pattern. A sensor (not shown) reads the marks on the encoder and forms a unique electrical pattern, such as a series of pulses, which is indicative of the position of the side guide and indicative of a dimension of the media on the support surface.

FIG. 3 shows a three dimensional view of the print media tray and linear encoder in accordance to an embodiment. The side plate 202 moves the linear encoder 204 through a linkage in the direction indicated by arrow 305. When the side guide is moved the linear encoder 204 is also moved, when the tray 110 is closed a set number of encoder sensor pulses will be seen and therefore the media size can be determined through appropriate circuitry or programmed logic.

Figure 4:
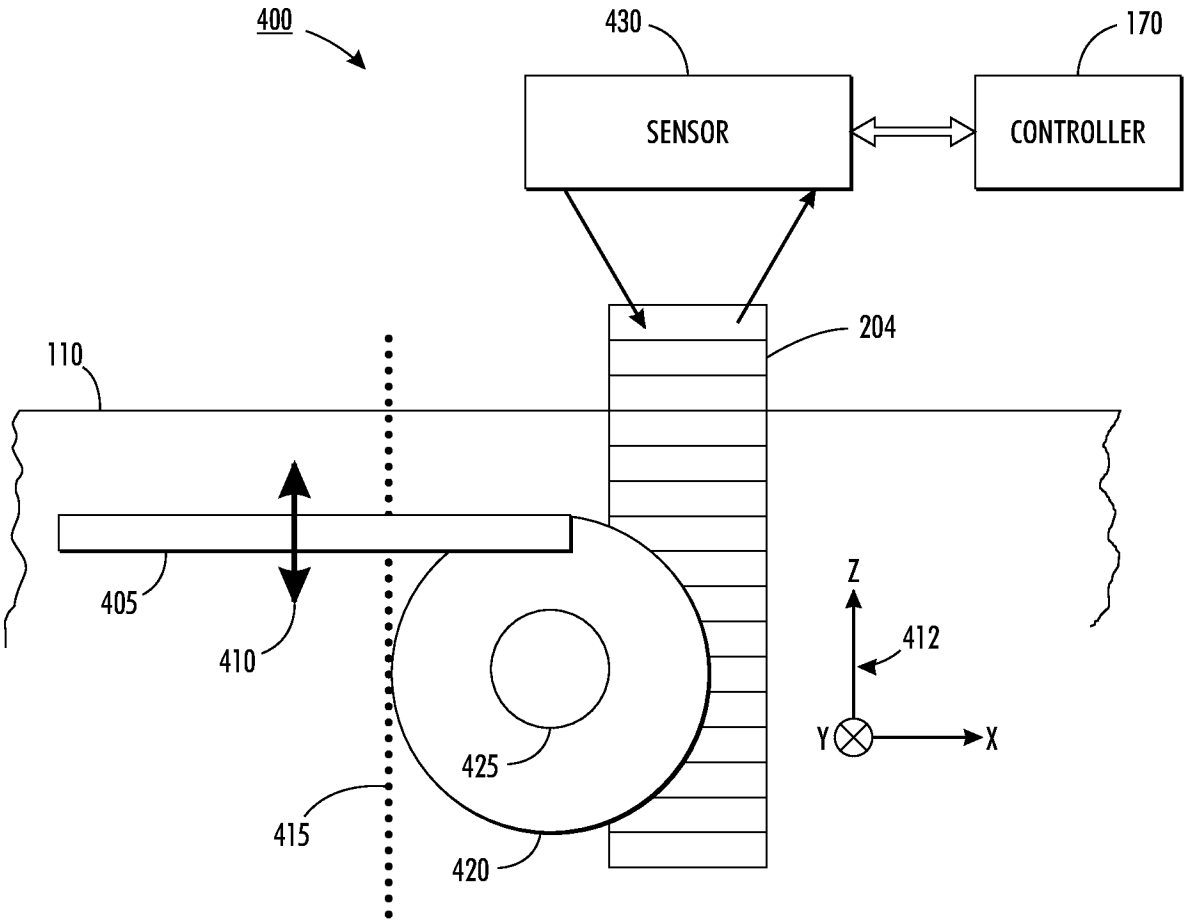
FIG. 4 is a representation of the linear encoder, side guide, and linkage mechanism for determining size of a received print media in accordance to an embodiment.

FIG. 4 is a representation of a print media size determining apparatus 400 having linear encoder, side guide, and linkage mechanism for determining the size of a received print media in accordance to an embodiment. A linear encoder is mounted to the tray which is connected to the media side guide. Media size detection is carried out by counting the number of encoder pulses when the tray is closed. Encoder can also be checked when the tray is opened to keep an ongoing calibration of the tray size. When the media side guide is moved the linear encoder is also moved, when the tray is closed a set number of encoder sensor pulses will be seen and therefore the media size can be determined. The print media size determining apparatus 400 comprises at least one side guide 405, a linkage mechanism consisting of a pinion 425 and gear 420, and a linear encoder having at least one degree of freedom 412. In operation, a user moves the side guide in an up and down direction 410. The movement of the side guide causes rack 415 to rotate gear 420. Pinion 425 sitting on gear 420 also rotates in the same direction. The rotation of the pinion causes linear encoder to move in parallel with the movement of the side guide, i.e., encoder 204 experiences the same up and down direction as the side guide. An exposed portion or the complete linear encoder 204 is then interrogated by sensor 430 which generates a unique electrical pattern that is indicative of print media dimension. Controller 170 can then determine from the unique electrical pattern the size of the received print media in the print media tray and with the size of the print media controls aspects of the printing system operation. In the event that the tray is pushed "IN" and "OUT" whilst the sensor is over the encoder which would increase the number of pulses an additional sensor and encoder offset by 90 degrees could be used so as to detect forward and reverse motion. Controller 170 can be programmed to count the number of pulses of the sensor 430 responsive to the marks on the linear encoder 204, which correspond to the number of rotations of the linkage mechanism such as pinion 425 and gear 420.

As shown, linear encoder 204 could accommodate more than one side guide by proving a linking mechanism with more than one degree of freedom like two to measure length and width of the print media. The linking mechanism would move in the Z direction and in the X direction 412 as shown. The linear encoder 204 could be formed by a plurality of transparent and non-transparent line-shaped grids and equidistantly separated to form a straight strip pattern.

FIG. 5 is a simplified perspective view of a document handler of a general configuration well known in the art, showing how such a document handler can be used in conjunction with a photosensitive device such as a scanning system and the like. The document handler 500 includes, according to one aspect of the present invention, a side guide for holding sheets which are to be moved relative to the photosensor array within the scanner, thereby recording images on a sheet in a familiar manner. In the particular illustrated embodiment, side guides 502 are mounted near a tray 504 which holds sheets desired to be scanned. The guides 502 are adjustable in position to conform to the edges of a stack of sheets placed on tray 504. As is generally known with document handlers, such as in copiers and facsimile machines, the side guides 502 are of different configurations depending on whether the scanning system is center-registered or edge-registered. If the scanning system is center-registered, the side guides 502 ensure that the sheets originate from a position which is centered relative to the path of sheets passing through the document handler 500; in such a case, there will typically provided two such guides, which move in a complementary fashion to center the sheets. If the scanning system is side or edge registered, there is typically only one side guide, which conforms to one edge of the stack, with the opposite edge of the stack being urged against a fixed surface.

With reference to the present invention, there is provided, associated with the movable side guide or side guides 502, a position sensor indicated generally as 506, and which can be of any type apparent in the art, such as including optical detectors, mechanical detectors, and so forth. Position sensor 506 like sensor 430 generates a unique electrical pattern from an encoder like linear encoder 204. The function of the position sensor 506 is to detect the position of the side guides 502, and thereby determine the width and/or position of the sheets moving relative to the array of photosensors. By detecting the width and position of the sheets before it is scanned, it can readily be determined which groups of photosensors along the linear array are to be activated, and which need not be activated as the sheets are not passing relative thereto. The "group selector" indicated as 508 by can be in the form of a quantity of software allied with a scanner controller 530 of the scanner, facsimile, or digital copier, and operates to select the suitable groups of photosensors for activation in response to the detected position of the guides 502. The output of group selector 508, in a particular scanning situation, is the addresses of the start and stop groups of photosensors 55, which are sent to buses 42 and 44, which cause operation of the scanner in the manner described above.

The use of a position sensor 506 is useful in high-volume scanning situations, where speed and/or memory consumption is at a premium. A user interface 510 which can be used in lieu of the position sensor 506 for allowing a manual selection of which photosensors are to be activated along the array. The hardware illustrated in FIG. 4 and the flowchart (software) in FIG. 6, applied to determining the dimension of print sheets, can be used to a scanner to ascertain the size of the original document.

Figure 6:
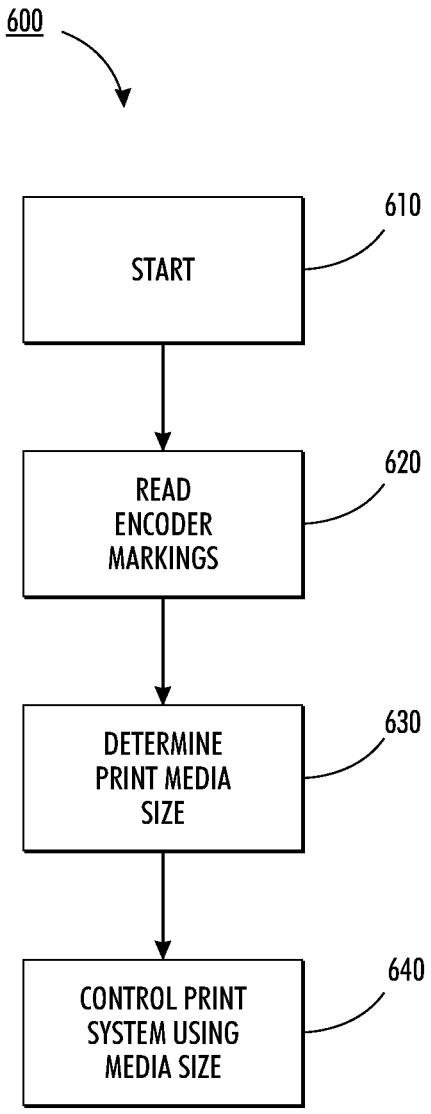
FIG. 6 is a flowchart of a method for determining print media size from encoder markings in accordance to an embodiment.

FIG. 6 is a flowchart of method 600 for determining print media size from encoder markings in accordance to an embodiment. Method 600 begins with the action 610 which starts the method for determining the size of one or more print media in print media tray 110. In action 620, the encoder markings are read at the sensor which is external to the print media tray. In action 630, the print media size is determined from the number of encoder markings. The determined print media size in action 630 is passed to action 640 so that a controller can control the printing system in accordance to the size of the media.

In accordance with the present invention, the size of paper present in the print media tray can be known at all times. Thus, the paper can be processed in a mode enhancing the throughput of the printing system. The sensor and linear encoder accurately determine paper dimensions such as length, width, and height when marshalled as a stack. The pint media size determining apparatus further requires little or no operator intervention, thus minimizing possible operator error.

While this invention has been described in conjunction with specific embodiments thereof it is evident that many alternatives, modifications, and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A sheet media size determining apparatus, comprising:

a tray having a support surface to receive print media;

at least one side guide in contact with at least one edge of the print media, the at least one side guide being movably supported to conform dimensionally with the print media received in the tray;

an encoder mounted in a slot on a side of the tray and connected through a linkage mechanism to the at least one side guide, movement of the at least one side guide causing the encoder to be linearly displaced in a direction along the slot in the side of the tray; and a sensor mounted in an image forming device in which the tray is inserted and external to the tray that senses an amount that the encoder is linearly displaced with respect to the side of the tray when the tray is inserted in the image forming device to generate a unique electrical pattern corresponding to a position of the at least one side guide relative to the tray based on the sensed amount that the encoder is linearly displaced along the side of the tray;

wherein the unique electrical pattern is indicative of the size of the print media received in the tray.

2. The sheet media size determining apparatus of claim 1, wherein the at least one side guide comprises two side guides, one of the two side guides indicative of print media width and the other of the two side guides indicative of print media length.

3. The sheet media size determining apparatus of claim 2, wherein the sensor comprises at least one of an optical sensor, a magnetic sensor, and a capacitive sensor, the sensor detecting marks on the encoder as the tray is inserted in the image forming device.

4. The sheet media size determining apparatus of claim 2, wherein the linkage mechanism transmits and rotates movement from the at least one side guide to cause the encoder to be linearly displaced in the direction along the slot in the side of the tray.

5. A printing system comprising:

a tray having a support surface to receive print media;

at least one side guide in contact with at least one edge of the print media, the at least one side guide being movably supported to conform dimensionally with the print media received in the tray;

an encoder mounted in a slot on a side of the tray and connected through a linkage mechanism to the at least one side guide, movement of the at least one side guide causing the encoder to be linearly displaced in a direction along the slot in the side of the tray; and a controller having a processor that executes instructions to determine a size of the received print media by:

sensing an amount that the encoder is linearly displaced with respect to the side of the tray when the tray is inserted in the printing system, generating from the sensed amount that the encoder is linearly displaced with respect to the side of the tray a unique electrical pattern corresponding to a position of the at least one side guide relative to the tray; and determining from the unique electrical pattern the size of the print media received in the tray.

6. The printing system of claim 5, wherein the at least one side guide comprises two side guides, one of the two side guides indicative of print media width and the other of the two side guides indicative of print media length.

7. The printing system of claim 6, wherein the controller comprises a sensor that is at least one of an optical sensor, a magnetic sensor, and a capacitive sensor that detects marks on the encoder as the tray is inserted in the printing system.

8. The printing system of claim 6, wherein the linkage mechanism transmits and rotates movement from the at least one side guide to cause the encoder to be linearly displaced in the direction along the slot in the side of the tray.

9. A media holding apparatus, comprising:

a tray having a support surface to receive print media;

at least one side guide in contact with at least one edge of the print media, the at least one side guide being movably supported to conform dimensionally with the print media received in the tray; and an encoder mounted in a slot on a side of the tray and connected through a linkage mechanism to the at least one side guide, movement of the at least one side guide causing the encoder to be linearly displaced in a direction along the slot in the side of the tray;

wherein markings on the encoder are read by an external sensor to determine an amount that the encoder is linearly displaced along the side of the tray to produce a unique electrical pattern corresponding to a position of the at least one side guide relative to the tray, and the unique electrical pattern is indicative of the size of the print media received in the tray.

10. The media holding apparatus of claim 9, wherein the at least one side guide comprises two side guides, one of the two side guides indicative of print media width and the other of the two side guides indicative of print media length.

11. The media holding apparatus of claim 10, wherein the external sensor is mounted in an image forming device in which the tray is inserted and is at least one of an optical sensor, a magnetic sensor, and a capacitive sensor that detects marks on the encoder to determine the amount that the encoder is linearly displaced along the side of the tray.

12. The media holding apparatus of claim 10, wherein the linkage mechanism transmits and rotates movement from the at least one side guide to cause the encoder to be linearly displaced in the direction along the slot in the side of the tray.

* * * * *